US005551103A

United States Patent [19]

Drozdowich et al.

[11] Patent Number: 5,551,103

[45] Date of Patent: Sep. 3, 1996

[54] APERTURED COUNTERTOP MOUNTING UNIT

[76] Inventors: Bryan G. Drozdowich, 32612 Hacienda Place, Clearbrook, British Columbia, Canada, V2T 1H6; Peter Zurba, 8557 Woodridge Place, Burnaby, British Columbia, Canada, V5A 4V3

[21] Appl. No.: 291,663

[22] Filed: Aug. 17, 1994

[51] Int. Cl.[6] ..... E03C 1/33

[52] U.S. Cl. ..... 4/631

[58] Field of Search ..... 4/631–635, 660

[56] References Cited

U.S. PATENT DOCUMENTS 4,374,695 2/1983 Ikeda et al. ..... 4/632 X

FOREIGN PATENT DOCUMENTS

| | | | |
|---|---|---|---|
| 2917144 | 11/1980 | Germany . | |
| 3420532 | 12/1985 | Germany . | |
| 4041586 | 10/1991 | Germany . | |
| 0159932 | 12/1980 | Japan | 4/632 |
| 2224648 | 5/1990 | United Kingdom | 4/632 |
| 2242626 | 10/1991 | United Kingdom | 4/632 |

*Primary Examiner*—Charles E. Phillips
*Attorney, Agent, or Firm*—Oyen Wiggs Green & Mutala

[57] ABSTRACT

An apertured mounting unit comprises a deck sheet with a top and a bottom surface, the sheet having a cross-sectional edge defining an aperture. A non-porous seal ring abuts the edge, the seal ring having top and bottom surfaces. The top and bottom surfaces of the seal ring adjacent to the edge being generally flush with adjacent top and bottom surfaces of the deck sheet.

29 Claims, 1 Drawing Sheet

APERTURED COUNTERTOP MOUNTING UNIT

FIELD OF THE INVENTION

The invention is in the field of countertop mounting units, such as sink mounts. More particularly, the invention relates to sealing means associated with sink mounts and the like.

BACKGROUND OF THE INVENTION

Laminated countertops are constructed with a thin surface layer of plastic laminate, such as FORMICA™ brand laminate from the Formica Corporation, Cincinnati, Ohio. The laminate is generally made up of layers of colored paper impregnated with polymeric resin and pressed into sheet stock. The surface laminate is typically bonded to a wood fibre core, such as plywood, particleboard or flake board. To mount a sink in a laminated countertop, a cross-sectional hole must be cut through the laminate and core. The wood fibre core exposed by the cross-sectional cut is generally porous, so that a seal must be used to exclude water from the unlaminated, cut edge of the countertop. Typically, this is achieved by dropping a sink with an upper circumferential flange into the mounting aperture from above, and sealing the flange against the laminated countertop.

The traditional mounting for flanged drop-in sinks gives rise to a number of problems. Because the flange is raised or bevelled, it is not possible to run cleaning solution over it freely, since the cleaner would not run back into the sink but out over the countertop. Perhaps more importantly, if the seal between the sink flange and the countertop laminate deteriorates, water can leak down into the exposed porous wood fibre edge of the countertop core. The positioning of the flange above the wood fibre edge facilitates this undesirable flow. Eventually, the countertop may suffer structural failure as the wetted core first swells, then looses its structural integrity altogether. Even before the fibre core fails, however, the area beneath a leaking sink flange may become an unsanitary habitat for the proliferation of microorganisms.

Solid surface countertops, such as granite, have long provided an alternative to laminated countertops. Although advantageous, solid surface countertops were initially too expensive for the mass market. In the 1960's, E. I. du Pont de Nemours and Company developed an alumina trihydrate filled methylmethacrylate polymer solid surface countertop material, marketed under the trade-mark CORIAN™. Similar polyester resin based "cast marble" synthetic products are also available, such as AVONITE™ (by Avonite, Inc., Belen, N. Mex)., FOUNTAINHEAD™ (by the Neveman Division of International Paper, Odenton, Md.) and SURELL™ (by Wilden Industries, Inc.). These solid surface materials generally have high temperature resistance, low thermal expansion, low water absorption (non-porous) and are hard and impact resistant. The widespread market acceptance of novel solid surface materials has led in turn to new developments in kitchen and bathroom fixtures.

Unlike laminated countertops, solid surface countertops lack a porous wettable core. As a result, a sink may be mounted to the underside of an aperture cut in a solid surface countertop, and the non-porous cross-sectional edge of the countertop left exposed without risk of damage to the countertop. To take advantage of this feature, a wide range of sinks are available that have been adapted for installation below countertop surfaces. These undermount sinks generally include an upper perimeter flange adapted to seal against the underside of a solid surface countertop.

At least in part because of the problems inherent in the typical top-mounting of drop-in sinks, undermount sinks have gained widespread acceptance for use with solid surface countertops. Unfortunately, solid surface countertops remain significantly more expensive than laminated countertops. As yet, however, no workable marriage exists between the economic advantages of laminated countertops and the aesthetic and functional advantages of undermount sinks.

SUMMARY OF THE INVENTION

It is an object of the invention to facilitate the use of undermount sinks with laminated countertops.

The invention provides an apertured mounting unit comprising a deck sheet with a top and a bottom surface. An aperture is cut in the deck sheet, so that the deck sheet has a cross-sectional edge that defines the aperture. The edge of the deck sheet exposed in cross-section is generally porous (relative, for example, to the surface of a laminated countertop). This is the case, if, for example, the deck sheet core is comprised of plywood, particleboard or flake board. A non-porous, and preferably rigid, seal ring abuts up against, and may be glued to, the deck sheet edge. The seal ring, like the deck sheet, has top and bottom surfaces.

The entire top and bottom surfaces of the seal ring adjacent to the edge of the deck sheet are preferably flush with the top and bottom surfaces of the deck sheet. Alternatively, at least 1/16 inch, in some embodiments ¼ inch, and preferably ½ inch, of the top and bottom surfaces of the seal ring adjacent to the edge are flat and flush with the adjacent top and bottom surfaces of the deck sheet. ½ inch of flat top surface on the seal ring provides ample room to seal a countertop laminate against the top surface of the seal ring. Similarly, ½ inch of flat bottom surface on the seal ring provides ample room to seal an undermount sink flange against the bottom surface of the seal ring. Of course, any appropriately flanged appliance or fixture may be attached to the underside of the countertop in sealing abutment with the bottom surface of the seal ring.

To manufacture the apertured mounting unit according to one embodiment of the invention, a deck sheet is provided. The deck sheet has top and bottom surfaces. An aperture is cut in the deck sheet, to form a cross-sectional edge on the deck sheet defining the aperture. The cross-sectional cut in the deck sheet exposes the porous core of the deck sheet. A seal ring, preferably rigid, having top and bottom surfaces is formed. The seal ring is dimensioned to fit inside the aperture and abut the edge of the deck sheet. The seal ring is inserted into the aperture in abutment with the cross-sectional edge of the deck sheet. Preferably, at least ½ inch of the top and bottom surfaces of the seal ring adjacent to the edge are flat and flush with the adjacent top and bottom surfaces of the deck sheet.

In one embodiment, the seal ring is formed by cutting at least two strips of appropriately dimensioned seal ring material from seal ring sheet stock. The strips of seal ring material are then heated to a temperature at which the strips are deformable. The strips may then be molded, each to an appropriate shape to fit against a portion of the deck sheet edge. The strips may then be bonded together to form the complete seal ring. A groove may then be cut in the bottom surface of the seal ring, into which a resilient gasket may be sealably seated.

The ready-made combination of deck sheet and seal ring may be conveniently shipped to consumers for final installation as a mounting unit. In which case, final installation involves joining the mounting unit to the remainder of a countertop core, the top and bottom surfaces of the mounting unit being aligned respectively with the top and bottom surfaces of the countertop core. Then, the top surface of the countertop, including the deck sheet and the top surface of the seal ring may be laminated. Once bonded, the countertop laminate layer seals against the top surface of the seal ring, to provide a countertop liquid barrier to keep water and other liquids away from the porous cross-sectioned core of the countertop exposed at the edge of the deck sheet. Excess laminate sheet may be trimmed from the countertop surface. As part of the trimming process, the solid surface ring seal material may be routed to an aesthetic and functional finished shape.

Once the countertop is laminated, an undermount sink, or other fixture, may be affixed to the bottom surface of the mounting unit. To seal the peripheral sink flange to the bottom surface of the seal ring, a bead of appropriate liquid sealant, such as silicone, is applied to the bottom surface of the seal ring before the sink flange is clamped to the bottom surface of the mounting unit. In addition, a resilient gasket may be seated in, and protrude downwardly from, a channel in the bottom surface of the seal ring. When the sink is in place, the gasket sealingly abuts the sink flange. The seal between the sink flange and the bottom surface of the ring seal provides a counter-bottom liquid barrier to keep water and other liquids away from the porous cross-sectioned core of the deck sheet.

When the seal ring is completely installed, it acts as a gasket, sealing the space between the countertop laminate and the undermount sink flange. The seal ring thereby isolates the relatively porous cross-sectioned core of the deck sheet from any liquid. A further barrier is provided by the abutment of the seal ring itself against the edge of the deck sheet. Preferably, the seal ring is glued to the edge, the adhesive providing a further barrier to keep liquid away from the porous cross-sectioned core of the deck sheet exposed on the edge of the deck sheet.

Although the deck sheet may be comprised of wood fibre material such as plywood, particleboard or flake board, in a preferred embodiment, the deck sheet is made of a dense water-resistant board, such as MEDITE™ or MEDIX™ brand board by the Medite Corporation (Medford, Oreg.). The use of such board further reduces the risk of water damage to the cross-sectioned edge of the deck sheet. In a commercial embodiment, the thickness of the deck sheet may be tailored to match the standard thickness of laminated countertop core materials in common use. In many areas of North America, for example, this will correspond to ⅝ inch. Similarly, the deck sheet may be cut to overall dimensions that facilitate installation of the mounting unit with standard laminated countertops, 27 inches wide by 49 inches long being one preferred size.

The seal ring may be made of molded plastic, such as cured polyester or acrylic resin based plastics. In a preferred embodiment, the plastic is comprised of solid surface countertop material, such as CORIAN™ brand sheet from the Dupont Company (methylmethacrylate polymer and alumina trihydrate filler) or FOUNTAINHEAD™ brand surface material (homogeneous, thermoset polymer alloy, comprised of polyester and acrylic components and filled with aluminium trihydrate).

A wide variety of solid surface countertop materials are available in standard sheet forms of varying thickness. To produce the seal ring of the invention, appropriate solid surface sheet material may be cut into appropriately dimensioned strips which are then heat formed to an appropriate shape. The temperature and duration of heat forming will vary with the material used. 315° Fahrenheit (F.)–330° F. is in some embodiments appropriate for CORIAN™ brand material, while 260° F.–290° F. is preferred in some embodiments for polyester resin based materials such as KARADON™, AVONITE™, FOUNTAINHEAD™, SURELL™ or GIBRALTAR™. The duration of heating will also vary with material size and composition, 15 to 20 minutes being preferred for ⅝"×½" strips of CORIAN™ brand material. Those skilled in the art will appreciate that variations in these specifications are appropriate in some circumstances, to produce the desired deformation of the solid surface material. Of course, it would also be possible to injection mold appropriate seal tings in a unitary form.

In one embodiment, the cross-sectional edge of the deck sheet is bevelled inwardly from the top surface of the deck sheet to the bottom surface, so that the top of the edge projects further into the aperture than the bottom of the edge. In this embodiment, the seal ring has a corresponding bevel, preferably 3 degrees from vertical.

DETAILED DESCRIPTION OF THE PREFERRED EMBODIMENT

Figure 1:
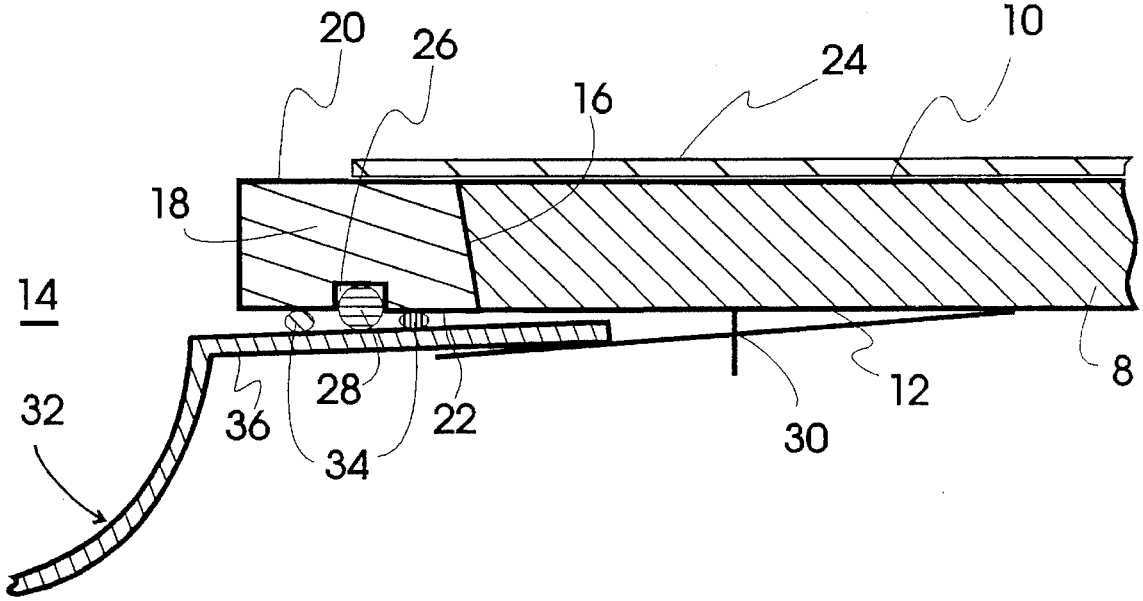
FIG. 1 is a partially fragmented cross-sectional view of the mounting unit together with an undermount sink and laminated countertop.
Figure 2:
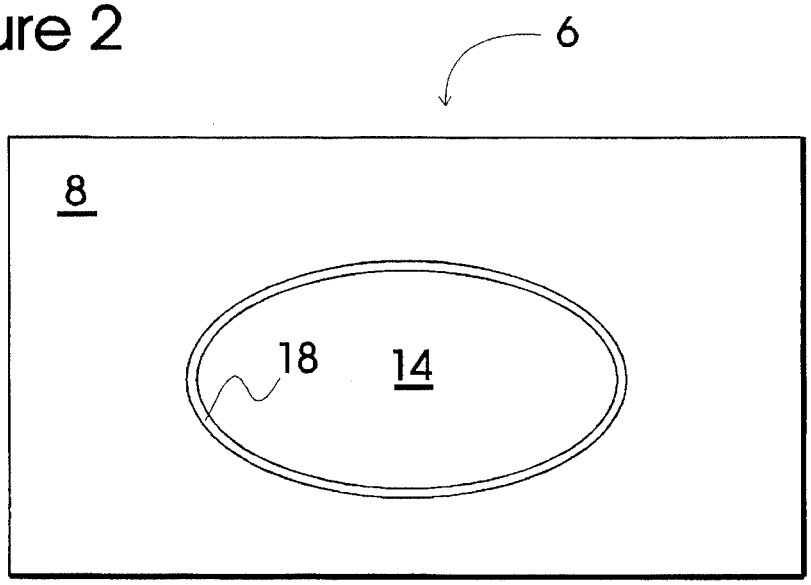
FIG. 2 is a plan view of an apertured mounting unit, showing the seal ring in the aperture defined by the deck sheet.

Apertured mounting unit 6 comprises deck sheet 8 and seal ring 18. Deck sheet 8 is preferably made of dense water-resistant board (MEDIX™ brand) and has top 10 and bottom 12 surfaces. Cross-sectional edge 16 of deck sheet 8 defines an aperture 14. Cross-sectional edge 16 is bevelled 3 degrees from vertical inwardly from the top surface of deck sheet 8 to the bottom surface, so that the top of edge 16 projects further into aperture 14 than the bottom of edge 16. A non-porous, rigid, seal ring 18 is glued to deck sheet edge 16. Seal ring 18 is made of heat formed CORIAN™ brand solid surface material (methylmethacrylate polymer and alumina trihydrate filler). Seal ring 18 has top 20 and bottom 22 surfaces and a 3 degree bevel on one side, corresponding to the 3 degree edge 16 bevel. Top 20 and bottom 22 surfaces of seal ring 18 adjacent to edge 16 are flush with top surface 10 and bottom surface 12 surfaces of deck sheet 8. Countertop laminate 24 is bonded to top surface 10 of deck sheet 8 and a portion of top surface 20 of seal ring 18, providing a seal across the top of edge 16. Clamps 30 affix undermount sink 32 to the underside of mounting unit 6. Resilient gasket 28 seated in groove 26 in bottom surface 22 of seal ring 18 is sealably compressed by sink flange 36. Beads of silicone sealant 34 help seal peripheral sink flange 36 to bottom surface 22 of seal ring 18.

To manufacture apertured mounting unit 6, aperture 14 is cut in deck sheet 8, forming cross-sectional edge 16. Cross-sectional edge 16 of deck sheet 8 is relatively porous. A rigid, non-porous seal ring 18, having top 20 and bottom 22 surfaces is formed. Seal ring 18 is dimensioned to fit inside aperture 14 and abut edge 16. Seal ring 18 is inserted into aperture 14 in abutment with cross-sectional edge 16, and glued into place against edge 16. Top 20 and bottom 22 surfaces of seal ring 18 are fiat and flush with the adjacent top and bottom 10, 12 surfaces of deck sheet 8.

Seal ring 18 is preferably formed by cutting two strips of appropriately dimensioned seal ting material from CORIAN™ brand sheet stock. The strips of seal ring material are then heated to a temperature at which the strips are deformable, 315 ° F.–330° F., 15 to 20 minutes of heating being preferred for ⅝"× ½" strips of CORIAN™ brand material. The strips are then molded, each to an appropriate shape to fit against a portion of deck sheet edge 16, and allowed to cool. The strips are then bonded together to form complete seal ring 18. Groove 26 is cut in bottom surface 22 of seal ring 18. Resilient gasket 28 is sealably seated in groove 26.

To install mounting unit 6 in a countertop, top and bottom surfaces of the deck sheet 10, 12 are aligned respectively with the top and bottom surfaces of an adjacent countertop core. Mounting unit 6 is jointed to the adjacent countertop core. Then, the top surface of the countertop, including top surface 10 of deck sheet 8 and top surface 20 of seal ring 18 are laminated. Beads of silicone sealant 34 are applied to bottom surface 22 of seal ring 18. Clamps 30 are used to affix undermount sink 32 to the underside of mounting unit 6.

As will be apparent to those skilled in the art in the light of the foregoing disclosure, many alterations and modifications are possible in the practice of this invention without departing from the spirit or scope thereof. For example, the mounting unit according to the invention may be used with a variety of fixtures, such as cutting boards, tubs, even port holes. Accordingly, the scope of the invention is to be construed in accordance with the substance defined by the following claims.

What is claimed is:

1. An apertured mounting unit comprising:

a deck sheet with a planar top surface and a planar bottom surface, the deck sheet having a porous cross-sectional edge defining an aperture in the deck sheet;

a non-porous seal ring, the outer peripheral surface of the seal ring abutting the cross-sectional edge, the inner peripheral surface of the seal ring defining an unobstructed opening through the mounting unit, the seal ring having a planar top surface and a planar exposed bottom surface, the planar top surface and the planar exposed bottom surface of the seal ring being coplanar respectively with the planar top surface and the planar bottom surface of the deck sheet; and, a resilient gasket sealingly seated in a channel formed in the planar exposed bottom surface of the seal ring.

2. The apertured mounting unit of claim 1, further comprising an adhesive bonding the seal ring to the cross-sectional edge.

3. The apertured mounting unit of claim 1, wherein the seal ring is comprised of polyester resin.

4. The apertured mounting unit of claim 1, wherein the seal ring is comprised of acrylic resin.

5. The apertured mounting unit of claim 1, wherein the seal ring is comprised of a cast acrylic resin and inert filler.

6. The apertured mounting unit of claim 1, wherein the seal ring is comprised of methylmethacrylate polymer and alumina trihydrate filler.

7. The apertured mounting unit of claim 1, wherein the seal ring is comprised of a homogeneous, thermoset polymer alloy, comprised of polyester and acrylic components and filled with aluminium trihydrate.

8. The apertured mounting unit of claim 1, further comprising a laminate sheet bonded to the planar top surface of the deck sheet and in sealing engagement with the planar top surface of the seal ring.

9. The apertured mounting unit of claim 1, wherein the deck sheet is comprised of a water-resistant high density board.

10. An apertured mounting unit comprising:

a deck sheet with a planar top surface and a planar bottom surface, the deck sheet having a porous cross-sectional edge defining an aperture in the deck sheet; and, a non-porous seal ring, the outer peripheral surface of the seal ring abutting the cross-sectional edge, the inner peripheral surface of the seal ring defining an unobstructed opening through the mounting unit, the seal ring having a planar top surface and a planar exposed bottom surface, the planar top surface and the planar exposed bottom surface of the seal ring being coplanar respectively with the planar top surface and the planar bottom surface of the deck sheet;

wherein at least a portion of the cross-sectional edge is bevelled so that in the bevelled portion of the cross-sectional edge an upper segment of the cross-sectional edge projects further into the aperture than a lower segment of the cross-sectional edge, such that the bevelled portion of the cross-sectional edge restricts the upward movement of the seal ring with respect to the deck sheet.

11. The apertured mounting unit of claim 10, wherein the bevelled portion of the cross-sectional edge is generally straight in vertical cross section and meets the planar bottom surface of the deck sheet at an obtuse angle and meets the planar top surface of the deck sheet at an acute angle.

12. The apertured mounting unit of claim 10, further comprising a resilient gasket on the planar exposed bottom surface of the seal ring.

13. An apertured mounting unit comprising:

a deck sheet with a planar top surface and a planar bottom surface, the deck sheet having a cross-sectional edge defining an aperture in the deck sheet;

a non-porous seal ring, the outer peripheral surface of the seal ring abutting the cross-sectional edge, the inner peripheral surface of the seal ring defining an opening, the seal ring having a planar exposed top surface and a planar bottom surface, the planar exposed top surface and the planar bottom surface of the seal ring being coplanar respectively with the planar top surface and the planar bottom surface of the deck sheet;

a utility member having a circumferential outwardly extending flange adapted for sealing engagement with the planar bottom surface of the seal ring and adapted to abut the planar bottom surface of the deck sheet, the utility member being supported on a bottom surface of the deck sheet; and, means for removably supporting the utility member on the bottom surface of the deck sheet so that the circumferential outwardly extending flange of the utility member is removably held

14. The apertured mounting unit of claim 13 wherein the means for supporting the utility member on the bottom surface of the deck sheet comprises a clamp mounted to the bottom surface of the deck sheet, the clamp being adapted to adjustably bias the circumferential outwardly extending flange of the utility member against the planar bottom surface of the deck sheet and against the planar bottom surface of the seal ring.

15. The apertured mounting unit of claim 14 further comprising a resilient gasket forming a seal between the planar bottom surface of the seal ring and the circumferential outwardly extending flange of the utility member, wherein the clamp is adapted to sealingly compress the resilient gasket between the circumferential outwardly extending flange of the utility member and the planar bottom surface of the seal ring.

16. The apertured mounting unit of claim 15 wherein the resilient gasket is sealingly seated in a channel formed in the planar bottom surface of the seal ring.

17. The apertured mounting unit of claim 15, wherein at least a portion of the cross-sectional edge is bevelled so that in the bevelled portion of the cross-sectional edge an upper segment of the cross-sectional edge projects further into the aperture than a lower segment of the cross-sectional edge, such that when the circumferential outwardly extending flange of the utility member is biased by the clamp against the planar bottom surface of the seal ring, the bevelled portion of the cross-sectional edge restricts upward movement of the seal ring with respect to the deck sheet.

18. The apertured mounting unit of claim 17, further comprising a laminate sheet bonded to the planar top surface of the deck sheet and in sealing engagement with the planar exposed top surface of the seal ring.

19. The apertured mounting unit of claim 14, wherein at least a portion of the cross-sectional edge is bevelled so that in the bevelled portion of the cross-sectional edge an upper segment of the cross-sectional edge projects further into the aperture than a lower segment of the cross-sectional edge, such that when the circumferential outwardly extending flange of the utility member is biased by the clamp against the planar bottom surface of the seal ring, the bevelled portion of the cross-sectional edge restricts upward movement of the seal ring with respect to the deck sheet.

20. The apertured mounting unit of claim 13 further comprising a resilient gasket forming a seal between the planar bottom surface of the seal ring and the circumferential outwardly extending flange of the utility member.

21. The apertured mounting unit of claim 20 wherein the resilient gasket is sealingly seated in a channel formed in the planar bottom surface of the seal ring.

22. The apertured mounting unit of claim 20, wherein at least a portion of the cross-sectional edge is bevelled so that in the bevelled portion of the cross-sectional edge an upper segment of the cross-sectional edge projects further into the aperture than a lower segment of the cross-sectional edge, such that the bevelled portion of the cross-sectional edge restricts the upward movement of the seal ring with respect to the deck sheet.

23. The apertured mounting unit of claim 13, wherein at least a portion of the cross-sectional edge is bevelled so that in the bevelled portion of the cross-sectional edge an upper segment of the cross-sectional edge projects further into the aperture than a lower segment of the cross-sectional edge, such that the bevelled portion of the cross-sectional edge restricts upward movement of the seal ring with respect to the deck sheet.

24. The apertured mounting unit of claim 13, further comprising a laminate sheet bonded to the planar top surface of the deck sheet and in sealing engagement with the planar exposed top surface of the seal ring.

25. The apertured mounting unit of claim 13 wherein the seal ring is comprised of methylmethacrylate polymer and alumina trihydrate filler.

26. The apertured mounting unit of claim 18 wherein the seal ring is comprised of methylmethacrylate polymer and alumina trihydrate filler.

27. An apertured mounting unit comprising:

a deck sheet with a planar top surface and a planar bottom surface, the deck sheet having a cross-sectional edge defining an aperture in the deck sheet;

a non-porous seal member abutting the cross-sectional edge, the seal member having a planar exposed top surface and a planar bottom surface, the planar exposed top surface and the planar bottom surface of the seal member being coplanar respectively with the planar top surface and the planar bottom surface of the deck sheet;

a utility member having an outwardly extending flange adapted for sealing engagement with the planar bottom surface of the seal member and adapted to abut the planar bottom surface of the deck sheet, the utility member being supported on a bottom surface of the deck sheet; and, means for removably supporting the utility member on the bottom surface of the deck sheet so that the outwardly extending flange of the utility member is removably held against the planar bottom surface of the deck sheet and in sealing engagement with the planar bottom surface of the seal member.

28. The apertured mounting unit of claim 27 further comprising:

a channel formed in the planar bottom surface of the seal member; and, a resilient gasket sealably seated in the channel;

wherein the means for supporting the utility member on the bottom surface of the deck sheet is adapted to sealingly compress the resilient gasket between the outwardly extending flange of the utility member and the planar bottom surface of the seal member.

29. The apertured mounting unit of claim 28 wherein the seal ring is comprised of methylmethacrylate polymer and alumina trihydrate filler.

* * * * *